US007175715B2

(12) United States Patent
Eiermann

(10) Patent No.: US 7,175,715 B2
(45) Date of Patent: Feb. 13, 2007

(54) METHOD AND DEVICE FOR DETERMINING THE DEPOSITS OF COMPONENTS FROM A LIQUID ON SURFACES, IN PARTICULAR LIQUID PUMPING MACHINES

(75) Inventor: Rudiger Eiermann, Syrgenstein (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 616 days.

(21) Appl. No.: 10/422,211

(22) Filed: Apr. 24, 2003

(65) Prior Publication Data

US 2004/0000320 A1 Jan. 1, 2004

Related U.S. Application Data

(63) Continuation of application No. PCT/EP01/11527, filed on Oct. 5, 2001.

(30) Foreign Application Priority Data

Oct. 26, 2000 (DE) ..... 10053220

(51) Int. Cl.
*B08B 3/02* (2006.01)

(52) U.S. Cl. ..... 134/10; 134/56 D; 134/113

(58) Field of Classification Search ..... 134/18, 134/56 D, 58 D, 113
See application file for complete search history.

(56) References Cited

U.S. PATENT DOCUMENTS 3,732,074 A * 5/1973 Feilter, Jr. ..... 436/6
5,101,851 A * 4/1992 Abadi et al. ..... 137/91
5,291,626 A 3/1994 Molnar et al.
5,341,661 A 8/1994 Dausch et al.
6,035,471 A * 3/2000 Lahrmann et al. ..... 8/158
6,341,615 B1 * 1/2002 Zorich et al. ..... 137/14
6,464,798 B1 * 10/2002 Rosenbauer et al. ..... 134/18
6,509,558 B1 * 1/2003 Loch et al. ..... 250/222.2

FOREIGN PATENT DOCUMENTS

| | | | |
|---|---|---|---|
| DE | 19825981 A1 | | 6/1998 |
| DE | 19904280 A1 | | 2/1999 |
| EP | 0966914 | | 12/1999 |
| JP | 59-23221 | * | 2/1984 |
| JP | 59-34135 | * | 2/1984 |
| JP | 60-135749 | * | 7/1985 |
| WO | WO 0046572 | | 8/2000 |

* cited by examiner

*Primary Examiner*—Frankie L. Stinson
(74) *Attorney, Agent, or Firm*—Russell W. Warnock; Craig J. Loest

(57) ABSTRACT

The invention relates to a method and device for determining the deposits of components from a liquid on surfaces, in particular in liquid pumping machines, comprising at least one body upon the surface of which said deposits occur, which affect the properties of an electromagnetic radiation, at least one transmitter and at least one receiver which measures the electromagnetic radiation emitted by the transmitter for the determination of the deposits. According to the invention, a calibration and a descaling of the sensor body may be avoided in a simple manner and whilst guaranteeing the secure function of the method and device, whereby any deposits of components from the liquid are removed from the surface of the body, without moving the body, at the beginning of a new measuring period.

20 Claims, 1 Drawing Sheet

Figure 1:
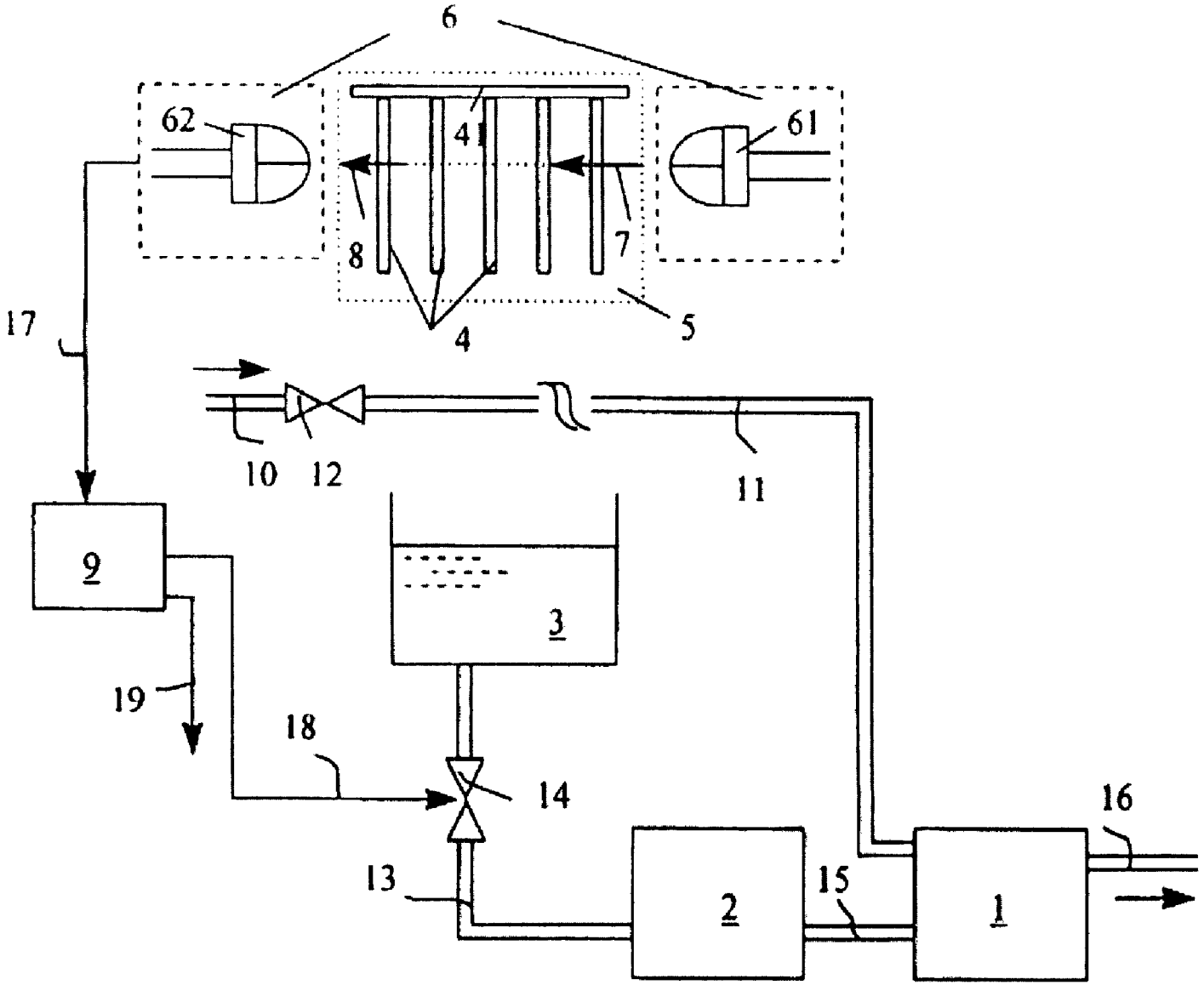

METHOD AND DEVICE FOR DETERMINING THE DEPOSITS OF COMPONENTS FROM A LIQUID ON SURFACES, IN PARTICULAR LIQUID PUMPING MACHINES

The invention relates to a method and a device for determining the deposits of components from a liquid on surfaces, in particular in liquid pumping machines, comprising at least one body upon the surface of which said deposits occur, which affect the properties of an electromagnetic radiation, at least one transmitter and at least one receiver which measures the electromagnetic radiation emitted by the transmitter for the determination of the deposits.

A method and a device of the type specified initially is known from DE 198 25 981 A1 wherein a transmitter transmits a light beam through a sensor body comprising a plurality of transparent surfaces to a receiver which can determine any attenuation of the passage of the light beam when there are lime-scale deposits on the surfaces and by means of a comparison with a pre-determined desired value, can initiate the implementation of a regeneration process of a water treatment device, in the exemplary embodiment of an ion exchanger shown. Since the lime-scale deposits build up continuously on the surfaces, the desired value must be adapted, for which a calibration not described in detail must be undertaken.

A method and a device of the type specified initially is also known from DE 199 04 280 A1 wherein a transmitter transmits a light beam through a transparent body, the light being introduced into the body so that it is refracted many times at the surface of the body. The receiver can detect any attenuation of the incident light beam and, as described above, by means of a comparison with a preset desired value, can initiate the implementation of a regeneration process of a water treatment device, in the exemplary embodiment of an ion exchanger shown. The adaptation of the preset desired value—the calibration—is explained in this publication, wherein it is further described that by means of the calibration it can also be determined whether the deposits on the body are so thick that they must be removed. How this is to be accomplished, however, is not described. In order to clean the body after the continuous build-up of deposits, which mainly comprise lime-scale in the form of boiler scale ($CaCO_3$), it is necessary to de-scale the body, e.g. using vinegar or citric acid etc. whereby it would be simpler for the user of the liquid-pumping machine to remove the body and carry out the de-scaling described or to replace this body. This is an expensive process which is disruptive for the user.

The object of the invention is thus, in a method and a device for determining the deposits of components from a liquid on surfaces of the type specified initially, to avoid a calibration and a removal of the deposits by the user in a simple manner whilst guaranteeing the secure function of the method and the device for determining the deposits of components from a liquid on surfaces.

This object is solved by the invention by removing any deposits of components from the liquid from the surface of the body without moving the body at least at the beginning of a new measuring period. The sole FIGURE of the drawings is a diagram of an arrangement for carrying out the method of the present invention.

By the removal of deposits of components from a liquid at each beginning of a new measuring period, a calibration and a cleaning of the body by the user can be avoided in a simple manner. Any removal or exchange of the body also becomes unnecessary. An additional expenditure on control for the calibration as well as any necessary expensive shaping of the body suitable for removal is also avoided with the invention. Since, as explained initially, methods and devices of the type specified initially are mainly used for controlling the regeneration time of a water treatment device, e.g. of an ion exchanger, the measuring period is defined by the time interval from the beginning of the measurement until the triggering of regeneration of the ion exchanger. After the regeneration of the water treatment device, the ion exchanger, the new measuring period according to the invention begins with a sensor body completely free from deposits so that the calibration can be dispensed with.

According to a preferred feature of the invention, the deposits of components from a liquid are removed from the surface of the body without any mechanical influence on the surface whereby any damage to the sensor body is avoided and a secure function of the method for determining deposits of components from a liquid is guaranteed.

According to a further feature of the invention, the deposits of components from a liquid are removed without additional chemical action on the surface of the body, whereby the additional use of chemical cleaning agents such as citric acid etc. and any damage to the sensor body is avoided and the secure function of the method for determining deposits of components from a liquid is guaranteed.

According to a preferred feature of the invention, the surface of the body is acted upon using a mixture of soft water and cleansing additives. It has surprisingly been found in practice that small deposits of components from a liquid on surfaces, e.g., lime-scale and/or magnesium and/or residual deposits of a cleaner used, e.g., silicates etc., can be re-dissolved by the action of using a mixture of especially soft water and cleansing additives dissolved therein and used in any case. With this measure therefore, any kind of mechanical or additional chemical action by de-scaling agents such as citric acid etc., can be completely avoided whereby the process can proceed without any assistance from the user and completely unnoticed by the user.

In an especially advantageous fashion, the device comprising at least one body upon the surface of which deposits occur, which affect the properties of an electromagnetic radiation, at least one transmitter and at least one receiver which measures the electromagnetic radiation emitted by the transmitter for the determination of the deposits, for implementing the method described previously is built into a dishwasher and at least at the beginning of a new measuring period, any deposits of components from the liquid are removed from the surface of the body without moving the body. Thus, the device for implementing the method according to the invention has the same advantages as the method according to the invention.

Further advantageous developments of the invention are characterised in the dependent claims and their advantages are explained in the following exemplary embodiment of the invention.

In a water-pumping machine—in a dishwasher, in the exemplary embodiment in a domestic dishwasher—the method according to the invention for determining deposits of components from a liquid on surfaces is implemented as described in the following.

The domestic dishwasher has a transparent body, hereinafter called a sensor body, which is arranged such that deposits of components from a liquid can occur on its surface, as they can also occur on the material to be cleaned, which is incorporated in a treatment space of the domestic dishwasher. A cleaning liquid which acts upon the material to be cleaned is circulated in a known fashion in a dishwasher. The cleaning liquid usually consists of water to which cleansing agents are added in certain part program segments of the cleaning process. In order to enhance the efficiency of the cleansing agent, the water forming the basis of the cleansing liquid is usually softened by means of a water treatment device, in the exemplary embodiment described by means of an ion exchanger. This ion exchanger has a known capacity for the absorption of calcium ions whereby, with increasing absorption of calcium ions in the ion exchanger, increasingly fewer calcium ions can be removed from the water which has been passed through. This means that as the absorption capacity of the ion exchanger decreases, the water used becomes increasingly harder. It is known that when hard water evaporates, deposits are formed on the surface of heated objects, said deposits comprising mainly lime-scale in the form of boiler scale ($CaCO_3$) and/or magnesium carbonate ($MgCO_3$ etc.) and/or residual deposits of a cleaner used, e.g., silicates etc. These deposits are observed as an indication of the diminishing performance of the ion exchanger in the device according to the invention in order to be able to control the regeneration time of the ion exchanger. Said deposits influence the property of electromagnetic radiation, in the exemplary embodiment of a light beam described, so that the deviations can be measured. In the exemplary embodiment described, the light beam from a transmitter is introduced into the sensor body so that it is refracted many times at the surface of the sensor body. As deposits increasingly accumulate on the surface of the sensor body, a receiver can now detect an attenuation of the incident light beam as a result of the modified refraction of the light beam and can thereby determine the thickness of the deposits.

Alternatively according to the exemplary embodiment, a sensor body comprising a plurality of transparent surfaces can be arranged in the domestic dishwasher such that deposits can build up on its surfaces, as they can also build up on the material to be cleaned which is incorporated in the treatment space of the domestic dishwasher. In the exemplary embodiment described the light beam would be transmitted by a transmitter through the alternative sensor body to a receiver which can detect an attenuation of the passage of the light beam when there are lime-scale deposits on the surfaces.

In the event of a corresponding increase in the deposits, it can be concluded on the basis of a comparison with a preset desired value that the performance of the ion exchanger is near its end and the regeneration process is initiated. Since the deposits build up continuously on the surface, it would be necessary to adapt the desired value—a so-called calibration. Over the duration of use of the domestic dishwasher, the deposits on the sensor body become so thick however that they must be removed to achieve a clear measurement result. To clean the sensor body, the user of the domestic washing machine would need to de-scale the sensor body, e.g. using citric acid etc. for which purpose the sensor body may well be removed or exchanged.

In order to avoid a calibration and a de-scaling of the sensor body as described in a simple manner, according to the invention any deposits of components from the liquid are removed from the surface of the body without moving the body, at least at the beginning of a new measuring period. By removing deposits at each beginning of a measuring period, a calibration and a de-scaling of the sensor body is avoided in a simple manner. Furthermore, additional expenditure on control for the calibration and any necessary expensive shaping of the sensor body suitable for removal are also avoided. Also the entire process takes place without any assistance from the user. According to the invention, the deposits on the sensor body are removed without mechanical influence and without additional chemical action whereby any damage to the sensor body and disturbance in the function of the method according to the invention are avoided. This is achieved according to a preferred feature of the invention by acting upon the surface of the sensor body using a mixture of soft water and cleansing additive. It has surprisingly been found in practice that smaller deposits e.g., of lime-scale and/or magnesium and/or residual deposits of a cleaner used, e.g. silicates etc. on surfaces can be re-dissolved by acting thereupon using a mixture of especially soft water and cleansing additives dissolved therein, used in any case in domestic dishwashers. As has already been explained, the inventive method and the inventive device are mainly used to control the regeneration time of an ion exchanger. Thus, the measuring period is defined by the time interval from the beginning of the measurement until the triggering of the regeneration of the ion exchanger. Directly following the complete regeneration of the ion exchanger, including a flushing of the ion exchanger to remove residual salt constituents, the softest water is available in which the cleansing agent is now dissolved according to the invention and the mixture is applied to the sensor body.

A calibration and a de-scaling of the sensor body are avoided in a simple manner by the invention whilst guaranteeing the secure function of the method and the device for determining deposits of components from a liquid on surfaces.

Reference is had to the sole figure of the drawings, which is a block diagram of an arrangement for carrying out the method of the present invention for determining deposits from components of a liquid on surfaces in liquid pumping machines. A liquid softening device includes an ion exchanger 1, a container 2 for retaining a cleansing additive communicated with the ion exchanger 1, and a tank 3 in which the cleansing additive can be pre-mixed and that is selectively communicated with the container 2 via a valve 14, and a control unit 9 operatively connected via a connector 18 with the valve 14 for controlling operation of the valve 14. Water can be conducted via a conduit 10, upon opening of a valve 12, into a conduit 11 that is communicated with the ion exchanger 1 so that a regeneration of the ion exchanger 1 occurs, while, at the same time, the cleansing additive agent retained in the tank 3 is conducted to the ion exchanger 1. A sensor body 5 operatively connected to the control unit 9 includes a plurality of glass plates 4 disposed in spaced parallel relation to one another. A sensor 6 includes a receiver 62 and a transmitter 61 that emits electromagnetic radiation, representatively shown as beams 7 and 8, that passes through the sensor body 5. The receiver 62 receives and measures the emitted electromagnetic radiation that has passed through the sensor body 5. Water exiting the ion exchanger 1 has been subjected to softening via the ion exchange and, additionally, the cleansing additive fed from the tank 3 and the container 2 is added to the water during its passage through the ion exchanger 1. Thereafter, this now softened water having the cleansing additive therein is applied to the sensor body 5 to effect removal of deposits on the sensor body.

The invention claimed is:

1. A method for determining deposits from components of a liquid on surfaces in liquid pumping machines, including at least one transparent sensor body in the machine upon the surface of which the deposits occur, the deposits affecting the properties of electromagnetic radiation transmitted through the sensor body, comprising:

transmitting electromagnetic radiation through the sensor body;

receiving and measuring the electromagnetic radiation transmitted through said sensor body to determine the deposits on said sensor body; and at least at the beginning of a new measuring period removing substantially all deposits from components of a liquid from said surface of said sensor body without removing said sensor body from the liquid pumping machine by subjecting said sensor body surface to a mixture of soft water and a cleansing additive.

2. The method according to claim 1, including removing substantially all deposits from components of the liquid from said surface of said sensor body without mechanically treating said surface.

3. The method according to claim 1, including removing substantially all deposits from components of the liquid from said surface of said sensor body without using chemical cleaning agents.

4. The method according to claim 1, including a water treating device to soften said water and regenerating said water treating device to start said new measuring period.

5. The method according to claim 4, including said water treating device being an ion exchanger.

6. The method according to claim 1, including refracting said electromagnetic radiation a plurality of times from said sensor body surface as said electromagnetic radiation is transmitted through said sensor body.

7. The method according to claim 1, including said transparent sensor body having a plurality of transparent surfaces and transmitting said electromagnetic radiation through said plurality of transparent surfaces of said sensor body.

8. The method according to claim 1, including said liquid pumping machine being a dishwasher.

9. A device for determining deposits from components of a liquid on surfaces in liquid pumping machines, including at least one transparent sensor body in the machine upon the surface of which the deposits occur, the deposits affecting the properties of electromagnetic radiation transmitted through the sensor body, comprising:

a transmitter for transmitting electromagnetic radiation through the sensor body;

a receiver for receiving and measuring the electromagnetic radiation transmitted through said sensor body to determine the deposits on said sensor body; and subjecting said sensor body surface to a mixture of soft water and a cleansing additive at least at the beginning of a new measuring period for removing substantially all deposits from components of a liquid from said surface of said sensor body without removing said sensor body from the liquid pumping machine.

10. The device according to claim 9, including removing substantially all deposits from components of the liquid from said surface of said sensor body without mechanically treating said surface.

11. The device according to claim 9, including removing substantially all deposits from components of the liquid from said surface of said sensor body without using chemical cleaning agents.

12. The device according to claim 9, including a water treating device to soften said water and regenerating said water treating device to start said new measuring period.

13. The device according to claim 12, including said water treating device being an ion exchanger.

14. The device according to claim 9, including said sensor body and said transmitter aligned to refract said electromagnetic radiation a plurality of times from said sensor body surface as said electromagnetic radiation is transmitted through said sensor body.

15. The device according to claim 9, including said transparent sensor body having a plurality of transparent surfaces and said transmitter transmitting said electromagnetic radiation through said plurality of transparent surfaces of said sensor body.

16. The device according to claim 9, including said liquid pumping machine being a dishwasher.

17. A device for determining deposits from components of a liquid on surfaces in a dishwasher, including at least one transparent sensor body in the machine upon the surface of which the deposits occur, the deposits affecting the properties of electromagnetic radiation transmitted through the sensor body, comprising:

a transmitter for transmitting electromagnetic radiation through the sensor body;

a receiver for receiving and measuring the electromagnetic radiation transmitted through said sensor body to determine the deposits on said sensor body;

a water treating device to soften said water and regenerating said water treating device to start a new measuring period; and subjecting said sensor body surface to a mixture of soft water and a cleansing additive at least at the beginning of said new measuring period for removing substantially all deposits from components of a liquid from said surface of said sensor body without removing said sensor body from the liquid pumping machine, including removing substantially all of said deposits from said surface of said sensor body without mechanically treating said surface and without using chemical cleaning agents.

18. The device according to claim 17, including said water treating device being an ion exchanger.

19. The device according to claim 17, including said sensor body and said transmitter aligned to refract said electromagnetic radiation a plurality of times from said sensor body surface as said electromagnetic radiation is transmitted through said sensor body.

20. The device according to claim 17, including said transparent sensor body having a plurality of transparent surfaces and said transmitter transmitting said electromagnetic radiation through said plurality of transparent surfaces of said sensor body.

* * * * *